US010196185B2

(12) United States Patent
Zoppas

(10) Patent No.: US 10,196,185 B2
(45) Date of Patent: Feb. 5, 2019

(54) PUSH-PULL ASEPTIC CAP FOR BOTTLES

(71) Applicant: ACQUA MINERALE SAN BENEDETTO S.p.A., Scorze' (IT)

(72) Inventor: Enrico Zoppas, Conegliano (IT)

(73) Assignee: Acqua Minerale San Benedetto S.P.A., Scorze (IT)

( * ) Notice: Subject to any disclaimer, the term of this patent is extended or adjusted under 35 U.S.C. 154(b) by 84 days.

(21) Appl. No.: 15/361,381

(22) Filed: Nov. 26, 2016

(65) Prior Publication Data

US 2017/0152080 A1 Jun. 1, 2017

(30) Foreign Application Priority Data

Nov. 27, 2015 (IT) ..... 102015000077792

(51) Int. Cl.
*B65D 47/24* (2006.01)
*B65D 47/06* (2006.01)
(Continued)

(52) U.S. Cl.
CPC ..... *B65D 47/061* (2013.01); *B65D 1/0246* (2013.01); *B65D 41/04* (2013.01); *B65D 41/3428* (2013.01); *B65D 47/247* (2013.01)

(58) Field of Classification Search
CPC ..... B65D 47/061; B65D 47/247; B65D 41/3428; B65D 1/0246; B65D 41/04
(Continued)

(56) References Cited

U.S. PATENT DOCUMENTS 2,936,935 A * 5/1960 Rabb ..... B65D 47/247 222/525
3,521,796 A * 7/1970 Roy ..... B65D 47/247 222/525

(Continued)

FOREIGN PATENT DOCUMENTS

DE 29708202 U1 5/1997
FR 1375655 B 9/1964

(Continued)

OTHER PUBLICATIONS

Italian Search Report and Written Opinion, Italian Patent Application No. 102015000077792 filed on Nov. 27, 2015, 9 pages, dated Jun. 12, 2016.

*Primary Examiner* — James N Smalley
(74) *Attorney, Agent, or Firm* — FisherBroyles, LLP; Susan M. Oiler

(57) ABSTRACT

A bottle push-pull aseptic dispenser cap comprising a guide-body having a reference axis and designed to be coupled to the mouth of a bottle; the guide-body being provided with a tubular shaped inner chamber closed at the bottom, and with through openings designed to place the inner space of the bottle in communication with the inner chamber. The cap further comprises a shutter-nipple which is coupled in an axially sliding manner to the guide-body so as to translate axially inside the inner chamber along the reference axis, between a retracted position, in which the shutter-nipple closes the through openings in a fluid-tight manner, and an extracted position, in which the shutter-nipple projects cantilevered outwardly from the guide-body and disengages the through openings so as to be able to receive, from the latter, said beverage through said inner chamber.

17 Claims, 7 Drawing Sheets

(51) Int. Cl.
*B65D 1/02* (2006.01)
*B65D 41/04* (2006.01)
*B65D 41/34* (2006.01)

(58) Field of Classification Search
USPC ..... 222/525, 559
See application file for complete search history.

(56) References Cited

U.S. PATENT DOCUMENTS

| | | | | | |
|---|---|---|---|---|---|
| 3,777,936 | A | * | 12/1973 | Hazard | B65D 47/247 222/153.14 |
| 4,020,981 | A | * | 5/1977 | Nixdorff | B65D 47/243 222/48 |
| 4,408,700 | A | * | 10/1983 | Fillmore | B65D 47/247 222/153.06 |
| 5,145,094 | A | * | 9/1992 | Perlmutter | B65D 47/247 215/311 |
| 2007/0199914 | A1 | | 8/2007 | Hung | |
| 2009/0057262 | A1 | | 3/2009 | Cho | |
| 2009/0230075 | A1 | | 9/2009 | Springer | |
| 2015/0266634 | A1 | | 9/2015 | Yang | |

FOREIGN PATENT DOCUMENTS

| | | | |
|---|---|---|---|
| FR | 2894566 | A1 | 6/2007 |
| FR | 2953814 | A1 | 6/2011 |

* cited by examiner

PUSH-PULL ASEPTIC CAP FOR BOTTLES

This application claims the priority of Italian patent application No. 102015000077792 filed on 27 Nov. 2015, the disclosures of which are incorporated herein.

The present patent application relates to a bottle push-pull aseptic dispenser cap.

BACKGROUND OF THE INVENTION

It is known that some beverage bottles generally made of plastic are provided with aseptic dispenser caps known as "push-pull" caps, which are structured to permit a user to easily dose the amount of beverage delivered from the bottle, and to hermetically seal the bottle upon re-closure.

For example, patent EP 1 065 150 describes a push-pull aseptic dispenser cap comprising a main cylindrical body, which has a vertical reference axis and is provided with an internally threaded ring that is screwed onto the thread obtained on the outside wall of the neck of the bottle. The main cylindrical body further comprises a first flat upper annular wall, orthogonal to the reference axis, which abuts against the upper edge of the neck, and a second flat upper wall that is above the first annular wall in a plane parallel thereto.

The push-pull aseptic dispenser cap further comprises a tubular projection that protrudes cantilevered from said second flat upper wall, in the opposite direction to the neck, so as to extend completely outside and above said neck, and a cylinder shaped dispenser cap, provided at the top with a central hole through which the beverage can flow out and provided at the bottom with a cylindrical stop element.

The dispenser cap is slidingly coupled to the tubular projection so that it can be moved axially between a lowered closed position, in which the cylindrical stop element is fitted in a fluid-tight manner in a central hole obtained in the second flat wall in order to seal the bottle hermetically, and a raised delivery position, in which the cylindrical stop element is at a distance from the second flat wall so as to disengage the through hole and place the space inside the bottle in communication with the central through hole in the dispenser cap, via a central channel in the projection, and thus to allow the beverage to be removed from the bottle.

The push-pull aseptic dispenser cap further comprises an external capsule shaped so as to be coupled to the main cylindrical body and thus internally contain the dispenser cap to protect it.

The push-pull aseptic dispenser caps of the type described above are widely used in the beverage bottle market in that they have made it possible to eliminate the paper-aluminium disk that was used in previous caps as a membrane to close the neck in order to guarantee the maintenance of the hermetic seal of the bottle prior to its use. In other words, the cap described above has an improved structure capable of both simplifying the processes of manufacturing the cap and of coupling it to the bottle, with a subsequent reduction in production costs, and of making the part handier for beverage consumers to use.

Recently, however, some needs have emerged, on the part of users and on the part of the producers of bottled beverages, which the present invention aims to satisfy.

Firstly, the need is felt to reduce the risk of contamination of the beverage via the cap, before and during the use of the bottle.

In that respect a first point to note is that the cap described above has some structural mechanical problems that seriously affect the bottlers capacity to withstand top loading, and therefore represent limits in terms of the volume of the bottle packaging. The weight of the other bottles stacked on top of a bottle is discharged, through the capsule, directly onto the dispenser cap and onto the tubular projection outside the neck and may in certain conditions, for example when a maximum weight limit is exceeded, cause plastic deformation/warping of the dispenser cap and of the tubular projection, and deterioration of the closing mechanism defined by the closing element and the hole. In this case, when an excessive downward force is applied by the bottom of the bottle on the closing element of the bottle beneath it, said closing element causes flaring of the hole, damaging the hermetic seal of the cap in the closed position and thus exposing the beverage to the risk of contamination.

At present, this problem is overcome by limiting the number of layers of bottles that are stacked in the packaging to below a maximum limit and by subjecting the cap to two sterilization processes before it is coupled to the bottle, that is, ionizing radiation and immersion of the cap in a sanitizing liquid.

In addition, the cap is also particularly prone to being a vehicle of contamination of the beverage during the use of the bottle by the user. During the use of the bottle, the dispenser cap repeatedly comes into contact with the hands of the user who, in practice, tends to take hold of it in order to more easily overcome the non-negligible resistance thereof to slide on the projection.

A second need is to reduce the risk of suffocation of users due to accidentally swallowing parts of the cap.

In that respect, it should be noted that the cap described above can easily be detached from the bottle. A simple manual operation is all that is required to unscrew the main body from the neck. Owing to the ease with which the cap can be detached, the user is able refill the bottle several times. Of course, since the bottle is designed and produced to be used just once, using it for too long and repeatedly fitting; removing the cap results in a weakening/wearing out of the parts of said cap, in particular of the dispenser cap, which will in time gradually tend to become detached from the projection and thus give rise to said risk of swallowing.

US 2015 266 634 A1 describes tubular fastening means fixed to the neck of the bottle and a cap member coupled to the tubular fastening means to close the bottle. The tubular fastening means are suitable to contain an article and comprise a tubular body with slots in the side, while the cap member is provided with an inner tubular portion that slides inside the tubular means between a closed position of the slots and an open position thereof so that the article contained in the tubular means is poured into the bottle. The cap described in US 2015 266 634 merely has the function of closing the bottle and is not suitable to be easily gripped between the lips/teeth of the user to allow the latter to drink the beverage contained in the bottle. Moreover, the cap member has the structural mechanical problems described above in that the weight of bottles stacked on top of it would tend to deform the upper annular portion 114 which protrudes above the neck of the bottle even in its closed condition.

US 2009 057 262 A1 describes a conventional bottle cap including an additive holding unit which is supported in the mouth of the bottle by an upper flange and contains an additive, and a tubular unit mounted so as to slide in the additive holding unit from and towards an extracted position in which it opens openings in the side of the additive holding unit to discharge the additive into the bottle, and is closed at the top by a seal. US 2009 057 262 is not suitable for use as a push-pull aseptic cap because once the upper seal has been opened the beverage is exposed to contamination.

FR 1 375 655 A describes a conventional dispenser spout that can be fitted by a user to the neck of the bottle and which is manually axially moved by the user to control the amount of beverage to be discharged. The dispenser spout described in FR 1 375 655 is not suitable for use as a push-pull aseptic cap because the beverage is highly susceptible to contamination both before and during the use of the bottle.

US 2009 230 075 A1 describes a conventional push-pull cap that is not suitable for use as an aseptic cap because during the use of the bottle it is repeatedly held by the user and can accidentally become detached from the bottle.

US 2007 0199 914 and DE 297 08 202 U1 also describe conventional push-pull caps in which the tubular projection always protrudes from the top of the neck and is therefore prone to the structural mechanical problems described above.

The Applicant has therefore conducted an in-depth study for the purpose of developing an improved push-pull aseptic dispenser cap, capable of achieving the following objectives:

- reduce contamination of the beverage:
- increase the top load that the cap is able to withstand during the packaging of the bottle;
- simplify the sterilization process;
- assure the "single use" of the bottle in order to reduce the risk of parts of the cap being swallowed.

SUMMARY OF THE INVENTION

The purpose of the present invention is thus to provide a solution that achieves at least the aims listed above.

The above purpose is achieved by the present invention in that it relates to a bottle push-pull aseptic dispenser cap characterized by comprising a guide-body having a reference axis and designed to be coupled to the mouth of a bottle; the guide-body being provided with a tubular shaped inner chamber, a central hub extending coaxially to said reference axis inside said tubular shaped chamber, and through openings obtained in a portion of the bottom wall of said guide-body surrounding said hub and designed to place the inner space of the bottle containing the beverage in communication with said inner chamber, and a shutter-nipple which is coupled in an axially sliding manner to said guide-body so as to slide axially inside the inner chamber along said reference axis, between a retracted position in which said shutter-nipple closes said through openings in a fluid-tight manner and has its upper end completely inside said inner chamber, and an extracted position in which said shutter-nipple disengages the through openings so as to be able to receive, from the latter, said beverage through said inner chamber and projects cantilevered outwardly from the guide-body so that it can easily be gripped between the user's lips/teeth; said shutter-nipple comprising a tubular body (16) which is separate and distinct from the guide-body; the tubular body is coupled in a telescopic manner in said inner chamber and internally incorporates a central stem which extends coaxially to said reference axis so as to be fitted in an axially sliding manner in said hub and cooperates with said tubular body so that said shutter-nipple can move between said retracted position and said extracted position.

This purpose is also achieved by the present invention in that it relates to an operating method of a bottle push-pull aseptic dispenser cap comprising: a guide-body having a reference axis and designed to be coupled to the mouth of a bottle; the guide-body being provided with a tubular shaped inner chamber, a central hub which extends coaxially to said reference axis inside said tubular changer, and through openings obtained in a portion of the bottom wall of said guide-body surrounding said hub and which are designed to place the inner space of the bottle containing the beverage in communication with said inner chamber; and a shutter-nipple which comprises a tubular body which is separate and distinct from the guide body and is coupled in a telescopic manner in said inner chamber and internally incorporates a central stem which extends coaxially to said reference axis so as to be fitted in an axially sliding manner in said hub; said method comprising the step of axially translating said shutter-nipple inside the inner chamber along said reference axis, between a retracted position in which said shutter-nipple closes said through openings in a fluid-tight manner and the upper end thereof is completely inside said inner chamber, and an extracted position in which said shutter-nipple disengages the through openings so as to be able to receive, from the latter, said beverage through said inner chamber and projects cantilevered outwardly from the guide-body so that it can easily be gripped between the user lips/teeth.

BRIEF DESCRIPTION OF THE DRAWINGS

The present invention will now be described with reference the accompanying drawings, which illustrate a non-limiting embodiment thereof, in which:

FIG. 13 is a slightly inclined perspective view from above of the shutter-nipple of the cap illustrated in FIG. 1; while

DETAILED DESCRIPTION OF THE INVENTION

The present invention will now be described with reference to the accompanying Figures in sufficient detail for those skilled in the art to produce and use it. Persons skilled in the art will be able to implement various modifications to the embodiments described herein and the general principles disclosed herein could be applied to other embodiments and applications without departing from the scope of the present invention, as disclosed in the appended claims. Accordingly, the present invent is not to be limited in scope to the embodiments described and illustrated herein, but is to be accorded with the widest scope consistent with the principles and characteristics disclosed and claimed herein.

Figure 1:
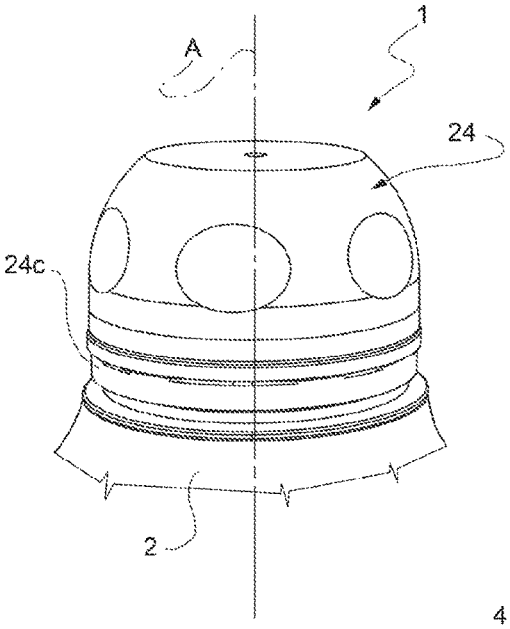
FIG. 1 shows a perspective view of a push-pull aseptic dispenser cap coupled to the mouth of a bottle, produced according to the teachings of the present invention.

With reference to FIG. 1, designated as a whole by number 1 fully "retractable" push-pull aseptic dispenser cap for bottles 2 designed to hold beverages, preferably, but not necessarily, so-called "pressurized" beverages. For example, the bottles 2 may contain water, orangeade, or any similar kind of beverage. In the case of so-called "pressurized" beverages, the pressure inside the bottle 2 may be, for example, approximately 1 Bar.

It worth pointing out that the cap implemented according to the present invention may also be used to close bottles 2 containing beverages that are not "pressurized", for example such as tea, fruit juice, or any other similar kind of beverage. Preferably, the bottle 2 to which the cap 1 is coupled may be of the single-use, or disposable type, it is made of plastic material, for instance polyethylene (PET) or a similar material, and essentially comprises a cylindrical neck or mouth 3 preferably having a smooth inner wall 3*a* and, preferably, an outer wall 3*b* that is at least partially threaded.

It is worth pointing out that, in the following description, purely for the purpose of improving the understanding of the present invention but without any loss of generality, the words upper, lower, horizontal, vertical, inner, outer, bottom and top will be used with reference to a vertical configuration of the bottle 2 according to that illustrated in the accompanying FIGS. 1-14.

Figure 2:
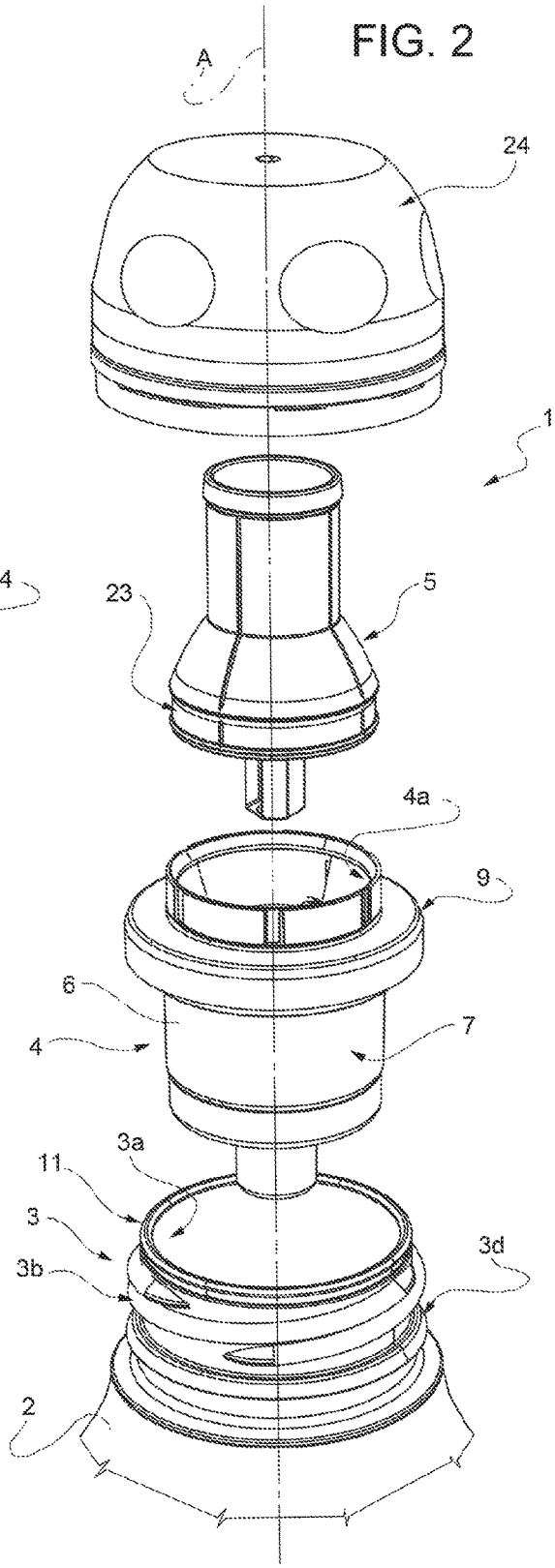
FIG. 2 is a perspective, exploded view of the push-pull aseptic dispenser cap shown in FIG. 1.
Figure 4:
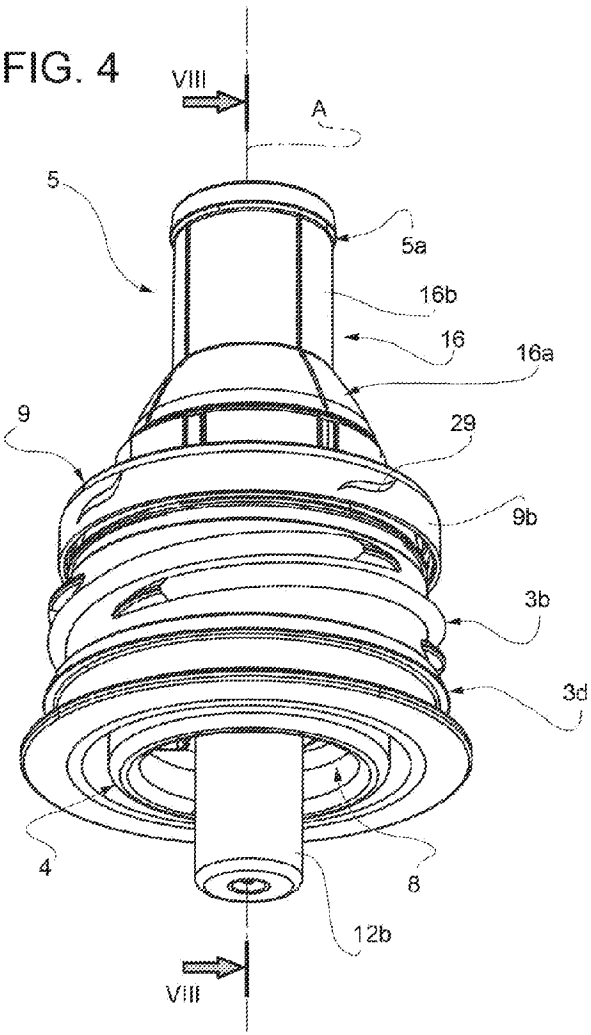
FIG. 4 is a vertical perspective view of the push-pull dispenser cap shown in FIG. 3 without the capsule.
Figure 3:
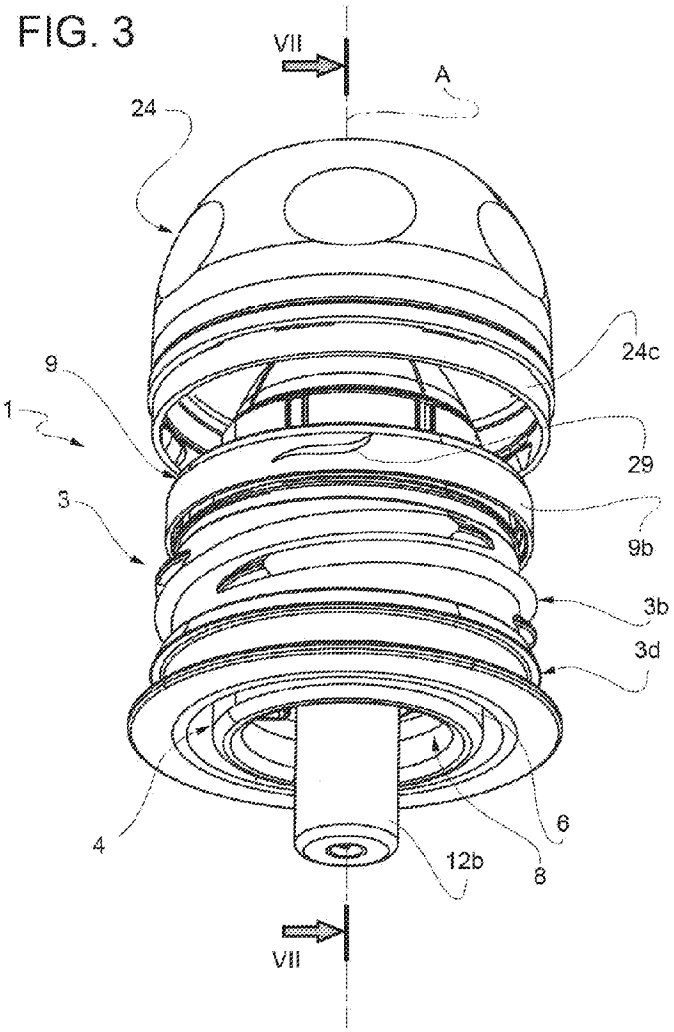
FIG. 3 is a vertical perspective view of the push-pull dispenser cap in an extracted position.

With reference to FIG. 2, the cap 1 comprises a guide-body 4 having a reference axis A (vertical in the example that is illustrated) and is designed to be permanently coupled, i.e., in a manually irremovable manner, to the mouth 3 of the bottle 2.

Figure 9:
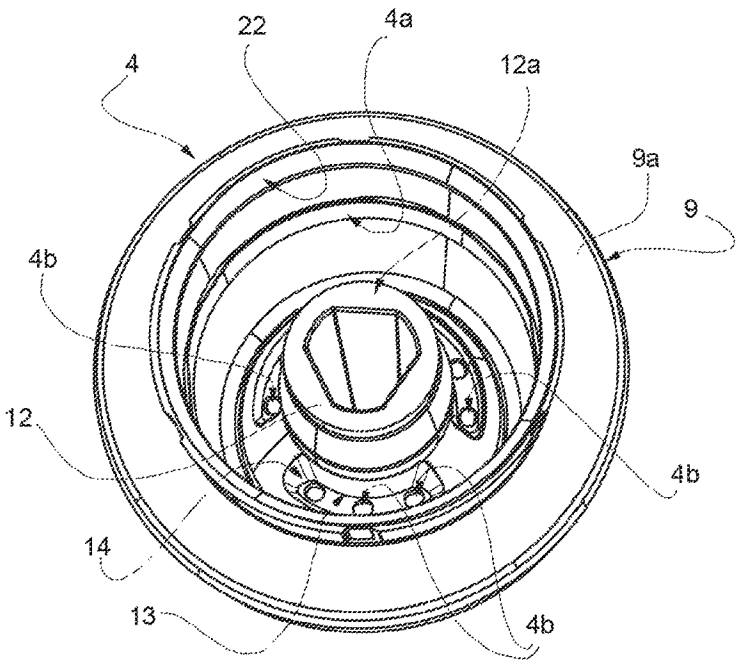
FIG. 9 is a perspective view, partially from above, of the guide-body of the push-pull aseptic dispenser cap shown in FIG. 1.
Figure 11:
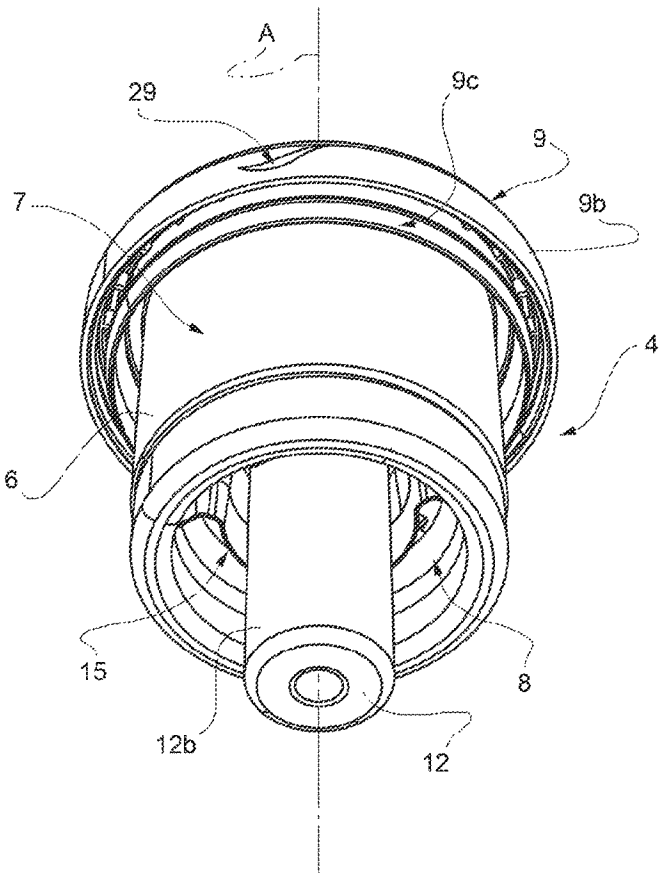
FIG. 11 is a substantially vertical perspective view partially from below of the guide-body illustrated in FIG. 9.

According to a preferred embodiment illustrated in FIGS. 1, 9 and 11, the guide-body 4 may be made of plastic material, such as for example polyethylene, preferably, but not necessarily, HDPE (High-Density Polyethylene) and is provided with a tubular shaped inner chamber 4*a* which extends inside the mouth 3 and is closed at the bottom. On the guide-body 4 there are also provided a series of through openings 4*b* which, under certain operating conditions (described in detail later on), place the inner space of the body of the bottle 2 containing the beverage in communication with the inner chamber 4*a* so that the latter is able to receive the beverage, during the discharge thereof.

With reference to FIG. 2, the cap 1 further comprises a straw or shutter-nipple 5, which is made of plastic material and is coupled in a telescopic manner in the guide-body 4 so as to axially move the guide-body 4 inside the inner chamber 4*a* along the axis A.

The shutter-nipple 5 can move axially inside the inner chamber 4*a*, between a retracted position (shown in FIGS. 5 and 6), in which the shutter-nipple 5 closes the through openings 4*b* to close the mouth 3 hermetically, and an extracted position (shown in FIGS. 3, 4, 7 and 8), in which the shutter-nipple 5 is arranged so that, on the one hand, it disengages the through openings 4*b* and thus allows the beverage to flow through them into the inner chamber 4*a*, and, on the other, it protrudes cantilevered from the guide-body 4 so that it can easily be gripped between the user's lip/teeth.

Figure 6:
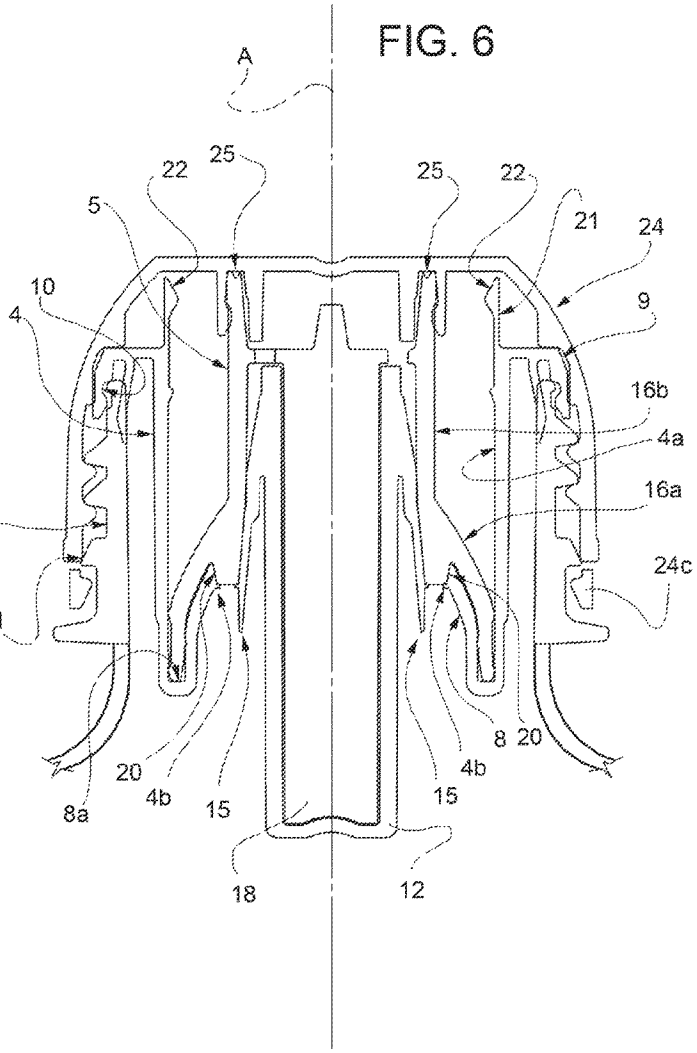
FIG. 6 is a vertical section of the push-pull aseptic dispenser cap in a retracted position.
Figure 5:
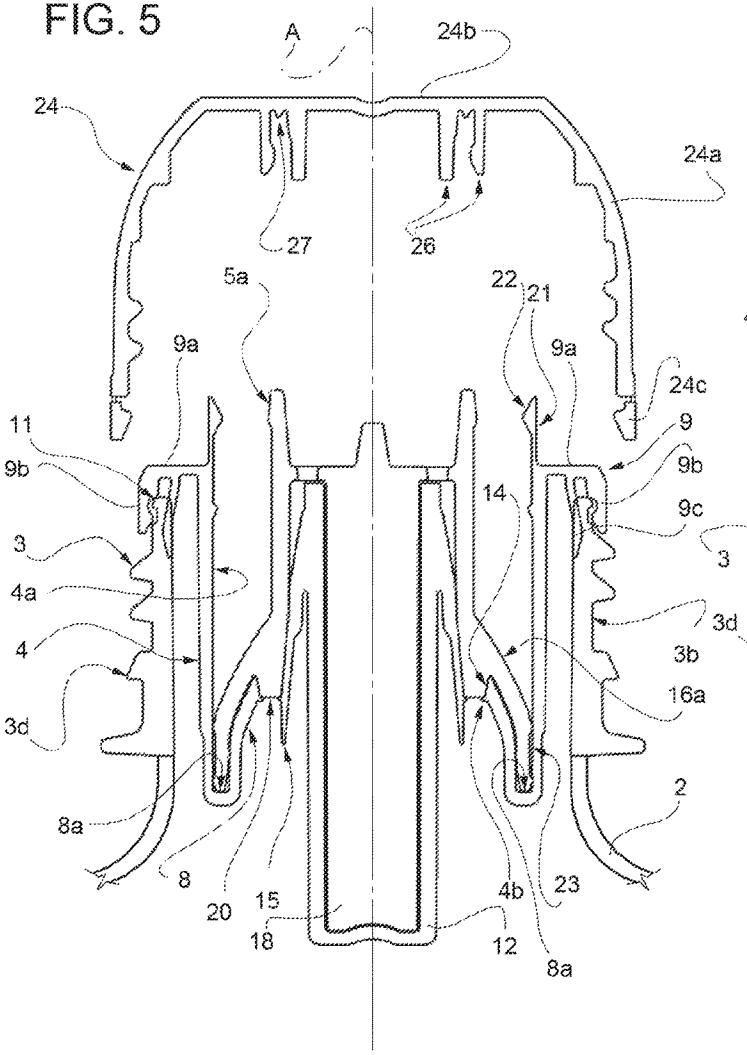
FIG. 5 is a vertical section of the push-pull aseptic dispenser cap shown in FIG. 1, in a retracted position, in which the capsule is uncoupled from the guide-body.

According to a preferred embodiment illustrated in FIGS. 5 and 6, in the retracted position, the shutter-nipple 5 is arranged inside the inner chamber 4*a* of the guide-body 4 so that, on the one hand, the shutter-nipple 5 engages the through openings 4*b* so as to close them in a fluid-tight manner, and, on the other, it has its upper distal end completely inside the inner chamber 4*a*. With reference to the example shown in FIGS. 5 and 6, in the retracted position, the shutter-nipple 5 conveniently assumes a so-called "retracted" position, in which said shutter-nipple 5 is contained/arranged completely inside the guide-body 4.

Figure 8:
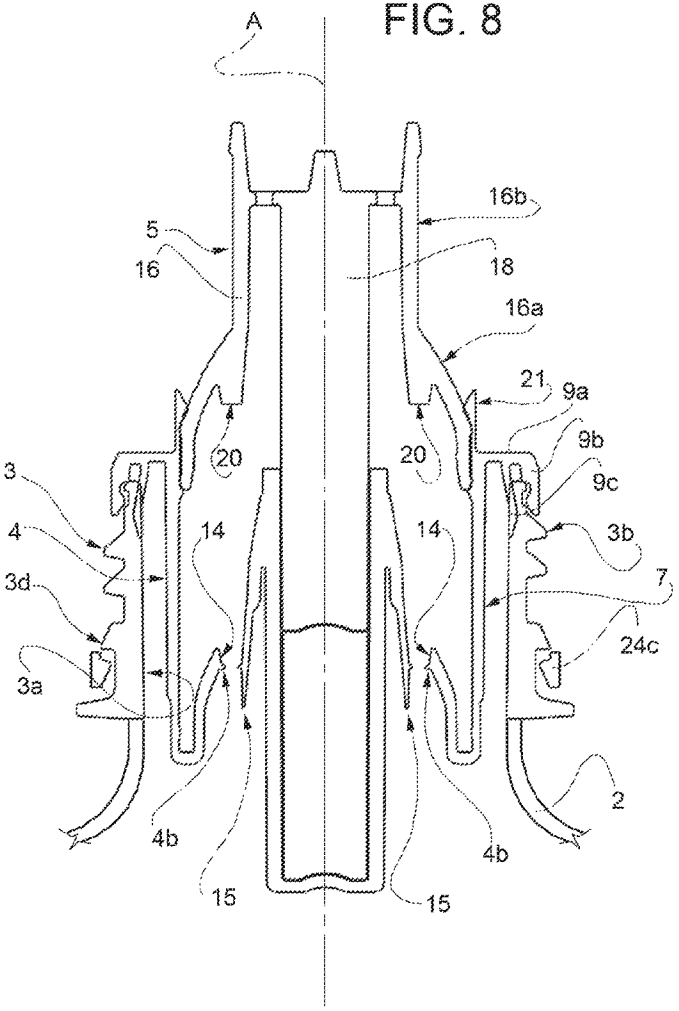
FIG. 8 is the section along the line VIII-VIII of the push-pull aseptic dispenser cap shown in FIG. 4.
Figure 7:
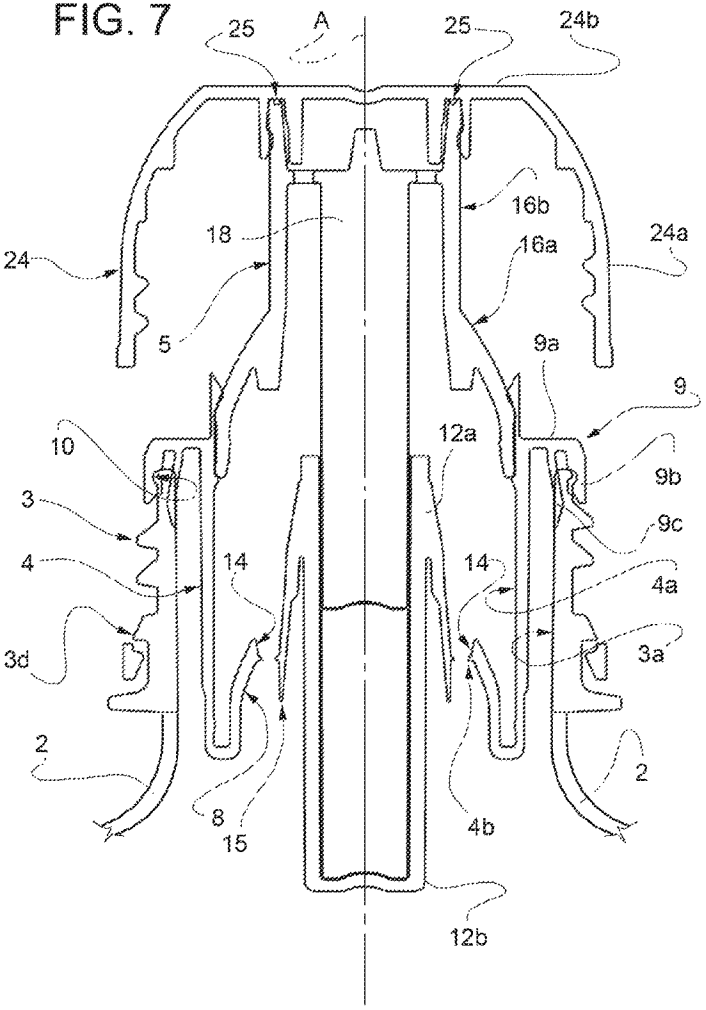
FIG. 7 is the section along the line VII-VII of the push-pull aseptic dispenser cap shown in FIG. 3.

According to a preferred embodiment illustrated in FIGS. 7 and 8, in the extracted position, the shutter-nipple 5 is arranged so that, on the one hand, it opens the through openings 4*b* to place the body of the bottle 2 containing the beverage in hydraulic communication with the shutter-nipple 5 via the inner chamber 4*a*, and, on the other, it extends cantilevered outwardly from the upper end of the guide-body 4 (top in FIGS. 4, 7 and 8) so as to allow the user to sip/suck the beverage through said shutter-nipple 5.

According to a preferred embodiment illustrated by way of example in FIGS. 2, 3, 5-8 and 11, the guide-body 4 comprises a cup-shaped body 6 that is fitted inside the mouth 3 of the bottle 2. In the example that is illustrated, the cup-shaped body 6 is provided with a cylindrical wall 7 that is fitted inside the mouth 3, is open at the top, and is closed at the bottom by a bottom wall 8. Preferably, the outer surface of the cylindrical wall 7 is substantially smooth (not threaded) and is shaped so as to be arranged facing the smooth inner surface 3*a* (not threaded) of the mouth 3. The cylindrical wall 7 extends coaxially to the axis A downwards starting from the top edge of the mouth 3 so as to lie/extend completely inside the mouth 3, whereas the inner surface of said cylindrical wall 7 forms/delimits the inner chamber 4*a* of the guide-body 4.

The upper edge of the cylindrical wall 7 incorporates an annular flange 9 structured so as to fasten the guide-body 4 to the bottle 2 in a manually irremovable manner.

According to a preferred embodiment illustrated in FIGS. 5-8 and 11, the annular flange 9 preferably has a substantially L-shaped profile. With reference to FIGS. 5-8, the annular flange 9 comprises a flat annular portion 9*a*, orthogonal to the axis A, which extends cantilevered outwards from the upper edge of the cylindrical wall 7 and has a portion of its bottom surface that abuts against the top annular edge of the mouth 3. The annular flange 9 further comprises a cylindrical annular portion 9*b* coaxial to the axis A, which extends downwards from the outer edge of the flat annular portion 9*a* and has its inner surface that abuts against/rests upon the outer surface of the mouth 3 preferably in correspondence with the top annular edge thereof. Preferably, the annular flange 9 further comprises an inner annular tongue 9*c* which extends downwards from an intermediate position of the flat annular portion 9*a*, between the outer surface of the cylindrical wall 7 and the cylindrical portion 9*b*, so as to abut against the inner surface of the mouth 3.

Preferably, on the inner surface of the cylindrical annular portion 9*b* there is also provided an annular seat 10 coaxial to the axis A, inside which, in use, a protruding projection or annular rib 11 of the mouth 3 is arranged. According to a preferred embodiment illustrated in FIGS. 2-8, the annular rib 11 protrudes outwards from a smooth circular sector of the outer surface of the mouth 3 arranged above the threaded portion, preferably in correspondence with the top edge of said mouth 3. The annular rib 11 may preferably be shaped to have a cross section (vertical) substantially complementary to the cross section (vertical) of the respective annular seat 10 so as to achieve with the latter, cooperating with the inner annular tongue 9*c*, a snap coupling (undercut coupling) of the guide-body 4 in the mouth 3.

The Applicant has found that the annular rib 11, when snapped into the seat 10, holds the guide-body 4 permanently anchored to the mouth 3 and thus achieves a manually irremovable coupling of the cap 1 to the bottle 2. Furthermore, the inner annular tongue 9*c* is structured to bend slightly inwards when fitted on the mouth 3 so as to press elastically on the inner surface of the mouth 3 and achieve a fluid-tight coupling on the latter.

Since, unlike with the caps with threaded coupling, the guide-body 4 of the cap 1 cannot be detached from the bottle 2 by means of a manual operation, this conveniently prevents the bottle from being re-used and re-filled when all the contents have been consumed.

With reference to the embodiment shown in FIGS. 2-11, the bottom wall 8 of the cup-shaped body 6 is substantially cap or bell shaped with the concavity/roundedness protruding towards the inside of said cup-shaped body 6. The bottom wall 8 comprises a central hub 12 closed at the bottom which extends inside the cup-shaped body 6 remaining coaxial to the axis A. With reference to the embodiment shown by way of example in FIGS. 9 and 10, the hub 12 may comprise an upper portion 12*a* which extends inside the inner chamber 4*a* towards the annular flange 9, and a lower portion 12*b* that extends preferably below the lower annular edge of the cup-shaped body 6 so as to partially protrude inside the body of the bottle 2.

Figure 10:
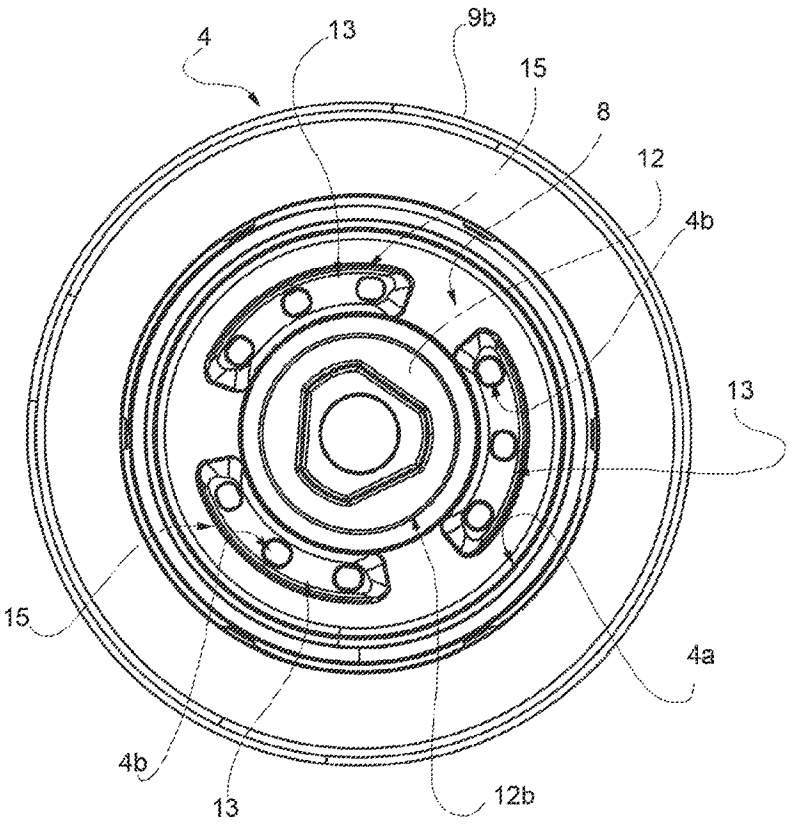
FIG. 10 is a plan view of the guide-body illustrated in FIG. 9.

According to a preferred embodiment illustrated in FIGS. 9-10, the through openings 4*b* consist of through holes, which are preferably obtained in the rounded portion of the bottom wall 8 surrounding the hub 12. Preferably, the through openings 4*b* may be distributed on the top of the roundedness of the bottom wall 8 that surrounds the hub 12 so as to form one or more perforated sectors 13 through which the beverage passes/flows towards the inner chamber 4*a*.

In the example that is illustrated, on the bottom wall 8 there are three perforated sectors 13 preferably arranged angularly at an equal distance from one another. According to a preferred embodiment described by way of example, each perforated sector 13 comprises a plurality of through holes, preferably three or more.

The Applicant has found that providing at least three perforated sectors 13 each with at least three through holes with a diameter of approximately 1 mm, achieves, on the one hand, the advantage of regulating the amount of beverage that can be discharged from the bottle through the holes and, on the other, of preventing the beverage from flowing through the holes when the bottle is tipped over.

According to a preferred embodiment illustrated in FIG. 9, the through openings 4*b* are obtained inside a series of concavities or recesses 14 formed in the rounded portion of the bottom wall 8 surrounding the hub 12. The recesses 14 are open towards the inner chamber 4*a*, whereas the through openings 4*b* are preferably obtained in the bottom walls of the recesses 14 on which they form said perforated sectors 13.

Preferably, as shown in the example in FIG. 10, the lower surface of the bottom wall 8 may also be provided with collars 15, each of which extends along the perimeter of a bottom wall of the respective recess 14 so as to surround the through openings 4*b* that are present in said recess 14. Each collar 15 conveniently forms a dispensing duct suitable to carry the beverage at a predefined flow rate towards the through openings 4*b*.

As far as the shutter-nipple 5 is concerned, it comprises a tubular body 16 coaxial to the axis A which is coupled in a telescopic manner to the cup-shaped body 6 so that it has a lower annular edge fitted so as to slide on the inner surface of the inner chamber 4*a*, and incorporates a central stem 18 which extends coaxially to the reference axis A and is, in turn, fitted in an axially sliding manner in the hub 12 so as to maintain the tubular body 16 in a substantially central position coaxial to the axis A, during the axial movement of the shutter-nipple 5.

The tubular body 16 is separate and distinct from the guide-body 4, that is to say, it is completely independent and detachable from the guide-body 4 and may preferably be made of polypropylene. The Applicant has found that when the tubular body 16 is made of polypropylene and the guide-body 4 of polyethylene, the lower annular edge of the tubular body 6 adheres well to the inner sliding surface of the inner chamber 4*a*. In use, the inner chamber 4*a*, which is less rigid than the tubular body 6, tends to become locally deformed when it comes into contact with the latter and its surface thus adapts to the rigid outside shape of the lower annular edge. This conveniently eliminates the possibility of cracks forming between the lower annular edge of the annular body 6 and the sliding surface of the inner chamber 4 and, thus, there is no possibility of the beverage that is flowing in the inner chamber 4 leaking out through said annular edge during the sliding of the nipple 5. The rigidity of the nipple also guarantees the continued alignment thereof, both during its axial translation and in the extracted position.

Figure 12:
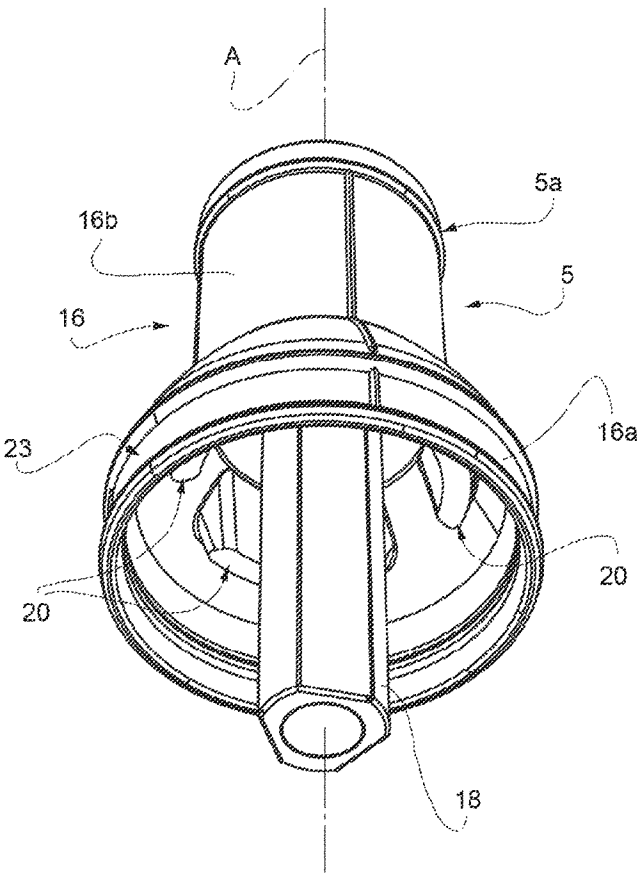
FIG. 12 is a substantially vertical perspective view partially from below of the shutter-nipple of the cap illustrated in FIG. 1.

According to a preferred embodiment illustrated in FIG. 12, the tubular body 16 has a flared or truncated cone shaped lower tubular portion 16*a* having the greater perimeter edge facing the bottom wall 8, and an upper tubular portion 16*b*, preferably cylindrical, which extends starting from the smaller upper perimeter edge of the lower tubular portion 16*a* towards the flange 9 and constitutes the end portion of the shutter-nipple 5 used by the user to drink the beverage.

The tubular body 16 is also provided with a series of internal closing segments or fins 20 which extend from the inner surface of said tubular body 16 towards the bottom wall 8, and are designed, in use, to abut against the bottom wall 8 so as to close, in a fluid-tight manner, the through openings 4*b* when the shutter-nipple 5 is in the retracted position.

According to a preferred embodiment shown in FIG. 12, the closing fins 20 are angularly distributed on the inner surface of the tubular body 16, preferably angularly equally spaced, so as to be aligned with the underlying recesses 14 along respective axes parallel to the axis A. The closing fins 20 also have free lower ends shaped so as to engage the recesses 14 in order to close the through openings 4*b* provided therein when the shutter-nipple 5 is in the retracted position and, vice versa, to disengage the recesses 14 to open the through openings 4*b* when the shutter nipple 5 is not in the retracted position (FIGS. 5-6).

In the example illustrated in FIG. 12, the closing fins 20 are fixed to the inner surface of the lower tubular portion 16*a* of the tubular body 16, preferably approximately on the smaller upper annular edge of said lower tubular portion 16*a* and are arranged in planes substantially parallel to the axis A (vertical in the Figures), whereas the free lower ends of the closing fins 20 may preferably, but not necessarily, have an arched shape complementary to a corresponding arched shape of the respective recesses 14.

As far as the lower tubular portion 16*a* is concerned, it may have an inner surface with a shape that is substantially complementary to the bottom wall 8 so as to be able to completely rest on the latter and at the same time fit its greater lower annular edge inside an annular groove 8*a* provided in the bottom wall 8 (FIGS. 5, 6, 7 and 8). Preferably, in the example shown in FIGS. 8 and 9, the lower portion of the bottom wall 8 may be substantially cylinder shaped, arranged adjacent to the lower portion of the cylindrical wall 7 so as to delimit therewith the annular groove 8*a*. Preferably, the annular groove 8*a* may be dimensioned so that, in use, it holds the greater lower annular edge of the lower tubular portion 16*a* so that the movement of the nipple 5 from the retracted position requires the application of a minimum predefined force by the user (FIGS. 5 and 6).

According to a preferred embodiment illustrated in FIGS. 2-8, the stem 18 of the nipple 5 and the hub 12 are coupled so as to be able to slide axially one with respect to the other. Preferably, the stem 18 of the nipple 5 and the hub 12 are also structured so as to be angularly fixed with respect to one another so that the nipple 5, in use, cannot rotate about the axis A with respect to the guide-body 4.

Preferably, with reference to FIGS. 9 and 12, the cross sections of the stem 18 and of the central inner tubular wall of the hub 12 which receives the stem 18 may be shaped to complement one another, so that the angular coupling between them determines the correct alignment of the closing fins 20 with the respective recesses 14. For example, the cross section of the stem 18 and the central duct of the hub 12 may be star shaped, toothed, triangular or of a similar shape.

The cap 1 may also be provided with a first mechanical end-of-stroke designed to stop the movement of the shutter-nipple 5 when the shutter-nipple 5 reaches the extracted position.

According to a preferred embodiment illustrated in FIGS. 5-8, the mechanical end-of-stroke may comprise a cylindrical collar 21 coaxial to the axis A, which extends cantilevered upwards from the flat annular portion 9*a* of the flange 9 and delimits with its inner surface the upper end portion of the chamber 4*a*.

The mechanical end-of-stroke may further comprise an annular projection 22, which protrudes inwards from the inner surface of the collar 21, and an annular groove 23 which is obtained in the outer surface of the lower tubular portion 16*a* in correspondence with the respective lower edge and is designed, in use, to be engaged by the annular projection 22 so as to stop the axial movement of the shutter-nipple 5 and thus prevent it from being uncoupled from the cup-shaped body 6.

The cap 1 further comprises a cover or capsule 24 that may be made of plastic material, such as for example polyethylene, preferably HDPE, and is designed to be coupled to the mouth 3 to protect the guide-body 4 and the shutter-nipple 5.

The capsule 24 is shaped so as to have a substantially cylindrical side wall 24*a* coaxial to the axis A, which has a threaded inner surface designed in use to be screwed onto the threaded outer surface of the mouth 3; and a flat wall 24*b*, which lies in a plane substantially orthogonal to the axis A, closes the upper end of the side wall 24*a*, and is designed in use to be arranged so that its inner surface abuts against the upper edge of the collar 21 when the capsule 24 is screwed completely onto the thread of the mouth 3 (FIG. 6).

The cap 1 further comprises a coupling member 25 designed to couple the capsule 24 in a stable but easily removable manner to the shutter-nipple 5 so that an axial movement of the capsule 24 along the axis A with respect to the mouth 3 results in a corresponding axial movement of the shutter-nipple 5 with respect to the guide-body 4.

According to a preferred embodiment illustrated in FIGS. 5-8 and 14, the coupling member 25 may further comprise on the inner surface an annular projection 26 coaxial to the axis A on which there is formed a central annular groove 27, designed to house the upper annular edge of the shutter-nipple 5. In use, the upper annular edge of the shutter-nipple 5 engages by interference in the annular groove 27 and remains trapped/held between the two inner walls of the annular projection 26 that delimit the annular groove 27 (FIGS. 6 and 7). Preferably, the upper annular edge of the shutter-nipple 5 is provided with an annular projection 5*a* that protrudes outwards and is arranged inside the annular groove 27 so that it is centrally anchored to the capsule 24 which is designed to axially slide the nipple 5. During the screwing/unscrewing of the capsule 24 on the mouth 3, the upper annular edge of the shutter-nipple 5 which is angularly fixed with respect to the guide-body 3, slides idly inside the groove 27 of the capsule 24 while remaining anchored thereto during the axial movement of the capsule 24.

Figure 14:
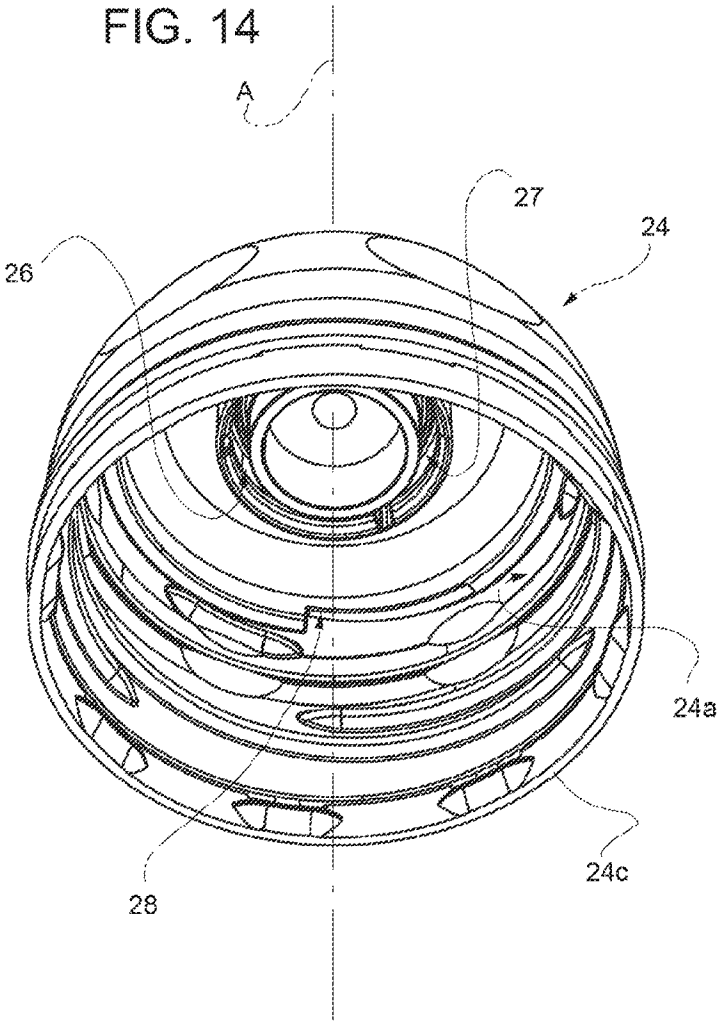
FIG. 14 is a partially inclined perspective view from below of the capsule of the cap illustrated in FIG. 1.
Figure 13:
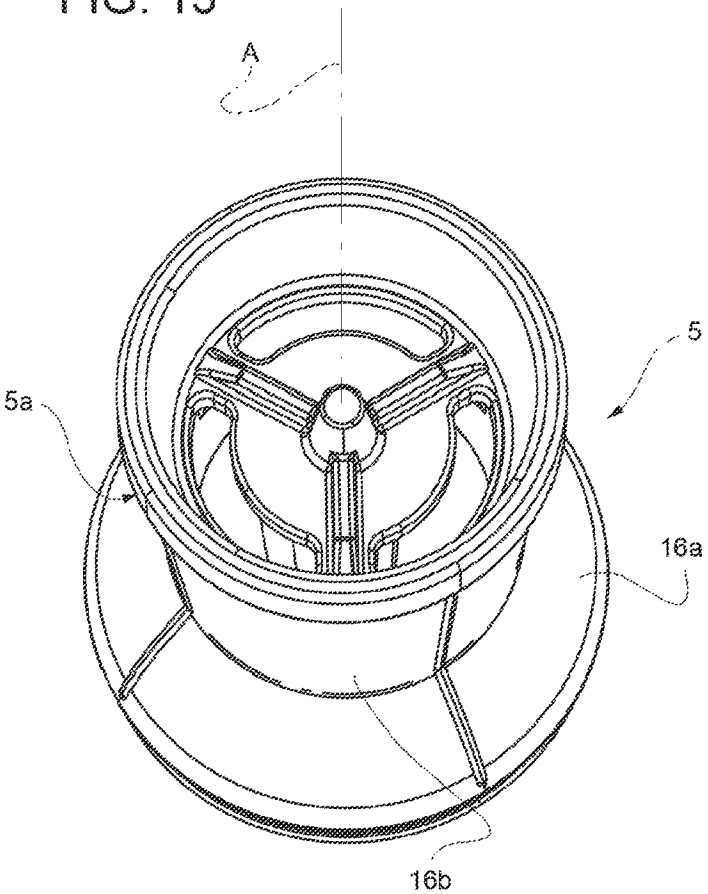

With reference to a possible embodiment, the capsule 24 further comprises three teeth 28 (only one of which is illustrated in FIG. 14) preferably helical shaped or rectilinear and sloping with respect to a plane orthogonal to the axis A, which are arranged angularly equally spaced from one another along the upper perimeter edge of the inner surface of the side wall 24*a*, and are designed in use to engage corresponding grooves 29 having a complementary shape obtained in the outer surface of the cylindrical annular wall 9*b* of the flange 9 (FIG. 11). The capsule 24 further comprises a breakable tamper-proof ring 24*c* that forms the lower part of the side wall 24*a*, which is preferably undercut-coupled to a ring or flat annular portion 3*d* arranged on the outer surface of the mouth 3 immediately below the threaded portion thereof. The breakable tamper-proof ring 24*c* is designed to break and come away from the remaining portion of the side wall 24*a* of the capsule 24 the first time the capsule 24 is raised axially from the annular portion 28 of the mouth 3 the first time said capsule 24 is unscrewed (FIG. 5).

The pre-assembly of the cap 1, its assembly on the bottle 2, and the relative operation will now be described. The cap 1 is pre-assembled by arranging the shutter-nipple 5 in the guide-body 4. In this case, the stem 18 is inserted in the hub and at the same time the tubular body 16 is coupled in a telescopic manner in the inner chamber 4*a* of the guide-body 4. The shutter-nipple 5 is then moved axially to the retracted position. The capsule 24 is coupled axially in the guide-body 4 and is partially rotated about the axis A to fit/screw the three teeth 28 of the capsule in the grooves 29 of the guide-body 4. The presence of the teeth 28 in the capsule 24 thus makes it possible to guarantee the angular coupling of the capsule 24 to the guide-body 4 and so prevent the accidental separation of the capsule 24 from said guide-body 4 during the assembly of the cap 1 on the bottle 2. In this step, the upper annular edge of the nipple 5 is coupled in the annular groove 27 of the capsule 24 and during the axial movement of the latter, its flat wall 24*b* makes the shutter-nipple 5 perform a brief axial movement along the axis A towards the bottom wall 8 to ensure that the nipple 5 reaches its retracted position in which the closing fins 20 engage in the recesses 14 closing the through openings 4*b* in a fluid-tight manner. It is worth pointing out that thanks to the hermetic closing of the through openings 4*b* achieved by the shutter-nipple 5, the tubular chamber 4*a* of the guide-body 4 is completely isolated from the outside.

The assembly of the pre-assembled cap 1 on the bottle 2 comprises the steps of: placing the annular flange 9 so that it rests on the upper perimeter edge of the mouth 3, screwing the capsule 24 onto the threaded portion of the mouth 3 to axially push/pull the guide-body 4 downwards to a closed/protection position, in which the annular rib 11 engages in the annular seat 10 so as to achieve a snap coupling between the guide-body 4 and the mouth 3, and in which the breakable tamper-proof ring 24*c* is arranged below the annular portion 3*d* of the mouth 3.

With reference to FIG. 6, when the capsule 24 is in the relative closed position, the shutter-nipple 5 is arranged completely inside the inner chamber 4*a*, that is, it is retracted, whereas the flat wall 24*b* of the capsule 24 rests on the upper edge of the cup-shaped body 6 which is in turn anchored to the upper edge of the mouth 3 by means of the annular flange 9.

With reference to FIG. 7, when the capsule 24 is unscrewed for the first time after being assembled on the bottle 2, the breakable tamper-proof ring 24*c* is held by the annular portion 3*d* of the mouth 3 and so comes away from the body of the capsule 24 during the upward movement thereof. When the capsule 24 is unscrewed from the mouth 3, it axially moves the shutter-nipple 5 by means of the coupling member 25 until it is completely unscrewed from the thread of the mouth 3. In this step, the upward movement of the annular body 16 causes the closing fins 20 to rise and disengage the recesses 14 and thus open the through openings 4*b*. The shutter-nipple 5 is moved to the extracted position by means of a simple axial movement of the capsule 24 outwards. During the axial movement of the capsule 24, the upper edge of the tubular body 16 remains trapped inside the annular groove 23 and the shutter-nipple 5 is thus extracted from the guide-body 4 until it reaches the extracted position.

When the shutter-nipple 5 reaches the extracted position (FIG. 8), the annular projection 22 engages in the annular groove 23 in order to act as a mechanical end-of-stroke that keeps the shutter-nipple 5 anchored to the guide-body 4 (FIG. 7). When the shutter-nipple 5 reaches the extracted position 5, a further axial movement of the capsule 24 along the axis A causes the uncoupling of the upper annular edge of the shutter-nipple 5 from the annular groove 27 of the capsule 24 which is thus uncoupled from the nipple 5. It is understood that when the operations described above are performed in reverse order, the shutter-nipple 5 moves towards the retracted position.

In the extracted position of the nipple 5, the beverage can be discharged from the bottle 2 to flow into the inner chamber 4*a*, through the through openings 4*b*, and can thus be delivered to the user through the tubular body 16 (FIG. 8).

The cap described above achieves the following advantages.

First, the cap is particularly robust and allows the bottle to withstand a greater top load. Unlike with the caps known in the prior art, the nipple of the present cap, in the retracted position, is arranged completely inside the chamber and so has no support function and is not subject to deformation/warping. The weight of any bottles stacked vertically on the capsule of the bottle underneath is fully discharged, through the flange of the cup-shaped body onto the top edge of the mouth of the bottle.

Furthermore, any downward forces applied by the bottles stacked on top of the bottle push the closing fins further into the respective recesses which increases the hermetic seal without causing any flaring of the holes or contamination of the beverage. The coupling of the closing fins in the recesses and the coupling of the capsule create an inner tubular chamber which is isolated from the outside environment. Thanks to this, the process of sterilizing the cap by means of radiation can be eliminated, with all the consequences in terms of cost reduction.

The arrangement of the nipple (retractable) inside the guide-body eliminates any risk of said nipple breaking when (for example after a fall) the upper portion of the bottle accidentally bangs against a rigid surface.

Moreover, the manually irremovable coupling achieved by the snap coupling of the flange to the mouth ensures that the bottle is only used once so that there is a lower possibility of the components accidentally coming off and the risk of swallowing such parts is greatly reduced.

Furthermore, thanks to the retracted position of the nipple inside the guide-body, i.e., inside the mouth, the push-pull cap described above does not affect the height of the bottle. In other words, unlike the conventional push-pull caps which define an upward extension of the bottle and so determine an increase in the overall dimensions of the cap-bottle, in terms of height, the height of the push-pull cap described above, in the retracted position, is substantially zero and thus entirely similar to conventional caps not of the push-pull type. For that reason the bottles provided with the cap described above can be stored in automatic dispensing machines for bottles with conventional caps, without requiring any changes to the storage and dispensing mechanisms of such machines.

The invention claimed is:

1. A bottle push-pull aseptic dispenser cap (1) of the retractable type characterized by comprising:

a guide-body (4) having a reference axis (A) and designed to be coupled to the mouth (3) of a bottle (2) in a manually unmovable manner; the guide-body (4) being provided with a tubular shaped inner chamber (4*a*), a central hub (12) that extends coaxially to said reference axis (A) inside said tubular chamber (4*a*), and through openings (4*b*) formed in a portion of a bottom wall (8) of said guide-body (4) surrounding said hub (12) and designed to place the inner space of the bottle (2) containing the beverage in communication with said inner chamber (4*a*);

a shutter-nipple (5) which is coupled in an axially sliding manner to said guide-body (4) so as to slide axially inside the inner chamber (4*a*) along said reference axis (A), between a retracted position in which said shutter-nipple (5) closes said through openings (4*b*) in a fluid-tight manner, and an extracted position in which said shutter-nipple (5) projects cantilevered outwardly from the guide-body (4) so that it can be easily gripped between the lips/teeth of the user and disengages the through openings (4*b*) so as to be able to receive, from the latter, said beverage through said inner chamber (4*a*);

said shutter-nipple (5) comprises a tubular body (16) which is separate and distinct from the guide-body (4); the tubular body (16) is coupled in a telescopic manner in said inner chamber (4*a*) and internally comprises a central stem (18) which extends coaxially to said reference axis (A) and is fitted in an axially sliding manner in said hub (12); the central stem (18) cooperates with said tubular body (16) so that said shutter-nipple (5) moves between said retracted position and said extracted position;

wherein said stem (18) and said hub (12) are angularly fixed one with respect to the other so that the nipple (5), in use, cannot rotate about the axis (A) relative to the guide-body (4).

2. The cap according to claim 1, wherein said through openings (4*b*) are made inside a series of concavities or recesses (14) formed in the bottom wall (8) of said guide-body (4).

3. The cap according to claim 1, wherein the through openings (4*b*) are distributed on the top of said bottom wall (8) surrounding the hub (12) so as to form one or more perforated sectors (13) through which the beverage passes/flows towards the inner chamber (4*a*).

4. The cap according to claim 1, wherein said through openings (4*b*) are made inside a series of concavities or recesses (14) formed in the bottom wall (8) surrounding the hub (12), said recesses (14) being open towards said inner chamber (4*a*), said through openings (4*b*) being made in the bottom walls of the recesses (14) so as to form in the latter perforated sectors (13).

5. The cap according to claim 1, wherein the guide-body (4) comprises a cup-shaped body (6) provided with a cylindrical wall (7) that is fitted inside the mouth (3), is open at the top, and is closed at the bottom by said bottom wall (8); said cylindrical wall (7) extending coaxially to said reference axis (A) starting from the top edge of the mouth (3) downwardly so as to be/extend completely inside the mouth (3); the inner surface of said cylindrical wall (7) forms/delimits said inner chamber (4*a*) of the guide-body (4).

6. The cap according to claim 1, wherein said through openings (4*b*) have a diameter of approximately 1 mm.

7. The cap according to claim 1, wherein said tubular body (16) comprises a series of closing fins (20) designed to close, in a fluid-tight manner, the through openings (4*b*) when the shutter-nipple (5) is in said retracted position.

8. The cap according to claim 1, wherein said tubular body (16) comprises a number of closing fins (20) that are angularly distributed on the inner surface of the tubular body (16) so as to be aligned with respective underlying recesses (14) formed in the bottom wall (8) and in which said through openings (4*b*) are made; said closing fins (20) also have free lower ends shaped so as to engage the recesses (14) in order to close the through openings (4*b*) therein when the shutter-nipple (5) is in the retracted position and, vice versa, disengage the recesses (14) to open the through openings (4*b*) when the shutter-nipple (5) is not in the retracted position.

9. The cap according to claim 8, wherein the cross sections of the stem (18) and of the central inner tubular wall of the hub (12), that receives the stem (18), are shaped to complement one another so that the angular coupling between them also determines the correct alignment of the closing fins (20) with the respective recesses (14).

10. The cap according to claim 1, wherein said tubular body (16) is made of polypropylene.

11. The cap according to claim 1, wherein said tubular body (16) has a truncated cone shaped lower tubular portion (16*a*) having the greater perimeter edge facing the bottom wall (8), and a cylindrical upper tubular portion (16*b*) which extends starting from the smaller upper perimeter edge of the lower tubular portion (16*a*) and forms the end portion of the shutter-nipple (5) used by the user to drink the beverage.

12. The cap according to claim 11, wherein said lower tubular portion (16*a*) has an inner surface with a shape that is substantially complementary to the bottom wall (8) so as to be able to completely rest on the latter and so that its greater lower annular edge fits inside an annular groove (8*a*) provided in the bottom wall (8); said annular groove (8*a*) is dimensioned so that, in use, it holds the greater lower annular edge of said lower tubular portion (16*a*) so that the movement of the nipple (5) from the retracted position requires the application of a minimum predefined force by the user.

13. The cap according to claim 1, provided with a mechanical end-of-stroke designed to stop the movement of the shutter-nipple (5) when the shutter-nipple (5) reaches said extracted position.

14. The cap according to claim 13, wherein said mechanical end-of-stroke comprises a cylindrical shaped collar (21) coaxial to the axis (A), that delimits with its inner surface the upper end portion of the chamber (4*a*), an annular projection (22), which protrudes inwardly from the inner surface of the collar (21), and an annular groove (23) obtained in the outer surface of the lower tubular portion (16*a*) in correspondence with the respective lower edge and designed, in use, to be engaged by the annular projection (22) so as to stop the axial movement of the shutter-nipple (5).

15. The cap according to claim 1, comprising a protecting and sliding capsule (24) which is designed to be coupled to said mouth (3) so as to contain said guide-body (4) and said shutter-nipple (5) in the inside thereof; said capsule (24) being provided with a coupling member (25) designed to couple said shutter-nipple (5) to the body of said capsule (24) so that an axial movement of said capsule (24) causes the axial movement of said shutter-nipple (5) along said reference axis (A).

16. A bottle for beverages, comprising the cap (1) according to claim 1.

17. An operating method of a bottle push-pull aseptic dispenser cap (1) of the retractable type comprising:

a guide-body (4) having a reference axis (A) and designed to be coupled to a mouth (3) of a bottle (2); the guide-body (4) being provided with a tubular shaped inner chamber (4*a*), a central hub (12) that extends coaxially to said reference axis (A) inside said tubular chamber (4*a*), and through openings (4*b*) formed in a portion of the bottom wall (8) of said guide-body (4) surrounding said hub (12) and designed to place the inner space of the bottle (2) containing the beverage in communication with said inner chamber (4*a*); and a shutter-nipple (5) which comprises a tubular body (16) that is separate and distinct from the guide-body (4), is coupled in a telescopic manner in said inner chamber (4*a*) and internally incorporates a central stem (18) which extends coaxially to said reference axis (A) so as to be fitted in an axially sliding manner in said hub (12);

said method comprising the step of axially translating said shutter-nipple (5) inside the inner chamber (4*a*) along said reference axis (A) between a retracted position in which said shutter-nipple (5) closes said through openings (4*b*) in a fluid-tight manner, and an extracted position in which said shutter-nipple (5) projects cantilevered from the guide-body (4) outwardly so that it can easily be gripped between the user's lips/teeth and disengages the through openings (4*b*) so as to be able to receive, from the latter, said beverage through said inner chamber (4*a*);

wherein said cap comprises a protecting and sliding capsule (24) which is designed to be coupled to said mouth (3) so as to internally contain said guide-body (4) and said shutter-nipple (5); said capsule (24) being provided with a coupling member (25) designed to couple said shutter-nipple (5) to the body of said capsule (24);

said method comprising the step of moving said capsule (24), coupled to said shutter-nipple (5), along said reference axis (A) to move said shutter-nipple (5) along said reference axis (A) between said retracted position and said extracted position.

* * * * *